US009445643B2

(12) United States Patent
Amos et al.

(10) Patent No.: US 9,445,643 B2
(45) Date of Patent: Sep. 20, 2016

(54) SOLE ASSEMBLY FOR ARTICLE OF FOOTWEAR EXHIBITING POSTURE-DEPENDENT CHARACTERISTICS

(71) Applicant: NIKE, Inc., Beaverton, OR (US)

(72) Inventors: Michael S. Amos, Beaverton, OR (US); Petre Gheorghian, Portland, OR (US); Martine I. V. Mientjes, Beaverton, OR (US); Erez Morag, Lake Oswego, OR (US)

(73) Assignee: NIKE, Inc., Beaverton, OR (US)

( * ) Notice: Subject to any disclaimer, the term of this patent is extended or adjusted under 35 U.S.C. 154(b) by 428 days.

(21) Appl. No.: 14/040,296

(22) Filed: Sep. 27, 2013

(65) Prior Publication Data

US 2014/0090277 A1 Apr. 3, 2014

Related U.S. Application Data

(63) Continuation of application No. 12/856,015, filed on Aug. 13, 2010, now Pat. No. 8,646,191.

(51) Int. Cl.

| | |
|---|---|
| ***A43B 7/14*** | (2006.01) |
| ***A43B 13/16*** | (2006.01) |
| ***A43B 13/20*** | (2006.01) |

(52) U.S. Cl.

CPC ..... *A43B 7/14* (2013.01); *A43B 7/148* (2013.01); *A43B 7/1425* (2013.01); *A43B 7/1435* (2013.01); *A43B 7/1445* (2013.01); *A43B 13/16* (2013.01); *A43B 13/20* (2013.01)

(58) Field of Classification Search

CPC ..... A43B 13/36; A43B 3/24; A43B 3/001; A43C 13/04; A43C 13/06; A43C 13/08; A43C 13/12; A43C 13/14; A43C 15/09; A43C 15/14

USPC ..... 36/35 R, 36 R, 36 A–36 C, 15, 31, 134

See application file for complete search history.

(56) References Cited

U.S. PATENT DOCUMENTS

| | | | | |
|---|---|---|---|---|
| 641,642 | A | 1/1900 | Gunn | |
| 1,155,506 | A | 10/1915 | Osaki | |
| 1,306,389 | A | 6/1919 | Osten | |
| 1,341,498 | A * | 5/1920 | Demarmels | A43B 3/128 36/141 |
| 1,964,406 | A | 6/1934 | Pellkofer | |
| 2,112,761 | A | 3/1938 | Buehner | |
| 2,168,303 | A | 8/1939 | Sothen | |
| 2,342,188 | A | 2/1944 | Ghez et al. | |
| 2,405,498 | A | 8/1946 | Gregg | |
| 2,466,611 | A | 4/1949 | Nicoletti | |
| 2,528,951 | A | 11/1950 | Epsztejn | |
| 2,590,648 | A | 3/1952 | Pitz | |
| 2,640,283 | A * | 6/1953 | McCord | A43B 5/00 36/130 |
| 2,760,279 | A | 8/1956 | Jones et al. | |
| 3,526,976 | A | 9/1970 | Jacobs | |
| 4,358,902 | A | 11/1982 | Cole et al. | |
| 4,559,724 | A | 12/1985 | Norton | |

(Continued)

*Primary Examiner* — Robert J Hicks
*Assistant Examiner* — Timothy K. Trieu
(74) *Attorney, Agent, or Firm* — Plumsea Law Group, LLC

(57) ABSTRACT

An article of footwear includes an upper and a sole assembly. The sole assembly includes a first member that is coupled to the upper and a second member that is moveably coupled to the first member. The first member moves relative to the second member in response to a first input load directed along a first vector, and the first member engages the second member in response to a second input load directed along a second vector.

20 Claims, 4 Drawing Sheets

(56) References Cited

U.S. PATENT DOCUMENTS

| | | | | |
|---|---|---|---|---|
| 4,610,100 | A | 9/1986 | Rhodes | |
| 4,918,838 | A | 4/1990 | Chang | |
| 5,042,175 | A | 8/1991 | Ronen et al. | |
| 5,317,822 | A | 6/1994 | Johnson | |
| 5,375,346 | A | 12/1994 | Cole et al. | |
| 5,392,537 | A | 2/1995 | Goldberg | |
| 5,617,653 | A | 4/1997 | Walker et al. | |
| 5,644,857 | A | 7/1997 | Ouellette et al. | |
| 5,682,689 | A | 11/1997 | Walker et al. | |
| 5,842,291 | A | 12/1998 | Schmidt et al. | |
| 5,921,009 | A | 7/1999 | Hice | |
| 5,956,870 | A | 9/1999 | Grossman et al. | |
| 6,301,807 | B1 | 10/2001 | Gardiner | |
| 6,315,305 | B1 | 11/2001 | Gien | |
| 6,349,487 | B1 | 2/2002 | Hice | |
| 6,550,160 | B2 | 4/2003 | Miller, II | |
| 6,725,572 | B1 | 4/2004 | Krstic | |
| 6,732,456 | B2 | 5/2004 | Hussain | |
| 6,829,848 | B2 | 12/2004 | Gallegos | |
| 6,966,130 | B2 | 11/2005 | Meschan | |
| 6,978,684 | B2 | 12/2005 | Nurse | |
| 7,254,904 | B2 * | 8/2007 | Nye | A43B 23/08 36/8.3 |
| 7,254,905 | B2 | 8/2007 | Dennison | |
| 7,644,521 | B2 | 1/2010 | McCarron | |
| 7,654,014 | B1 | 2/2010 | Moore et al. | |
| 7,721,466 | B2 | 5/2010 | Guo | |
| 7,752,775 | B2 | 7/2010 | Lyden | |
| 8,117,769 | B2 | 2/2012 | Steele | |
| 8,141,276 | B2 | 3/2012 | Ellis | |
| 8,220,184 | B2 | 7/2012 | Albert | |
| 8,250,780 | B1 | 8/2012 | Diaz | |
| 2005/0137511 | A1 | 6/2005 | Bailar | |
| 2005/0246923 | A1 | 11/2005 | Bergamin | |
| 2008/0022562 | A1 | 1/2008 | Manis | |
| 2009/0019730 | A1 | 1/2009 | Salminen et al. | |
| 2009/0234254 | A1 | 9/2009 | Bar-Haim et al. | |
| 2010/0018079 | A1 | 1/2010 | Albert | |

* cited by examiner

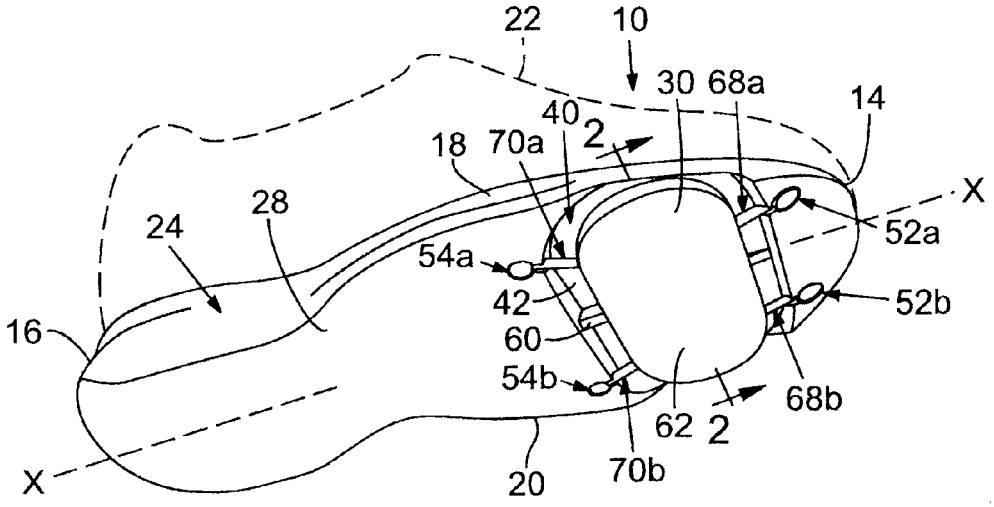
FIG. 1
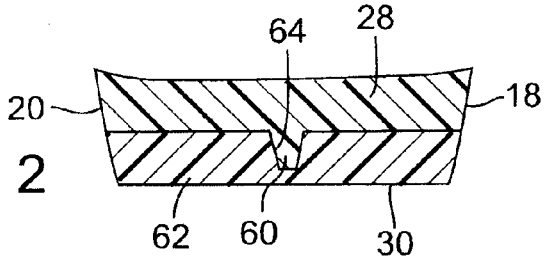
FIG. 2
FIG. 3
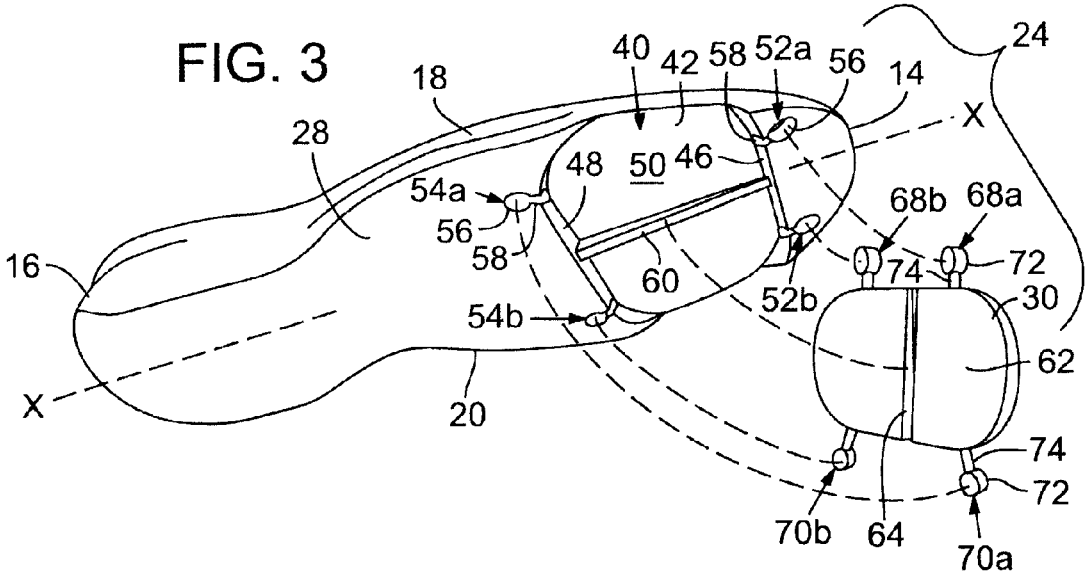

SOLE ASSEMBLY FOR ARTICLE OF FOOTWEAR EXHIBITING POSTURE-DEPENDENT CHARACTERISTICS

CROSS REFERENCE TO RELATED APPLICATION

This application is a continuation of co-pending application Ser. No. 12/856,015, filed Aug. 13, 2010, the disclosure of which is hereby incorporated by reference in its entirety.

FIELD

The present disclosure relates to an article of footwear and, more particularly, relates to a sole assembly for an article of footwear that exhibits posture-dependent characteristics.

BACKGROUND

Articles of footwear can include an upper and a sole assembly. The upper can include layers or sections of material that wrap about and cover a substantial portion of the wearer's foot and ankle. The upper can also include laces, straps, or the like for securing the footwear to the wearer's foot. The sole assembly can include an outsole and a midsole. The outsole can be a unitary piece of relatively high-friction material that provides traction. The midsole can include foam or other resilient material disposed between the outsole and the upper for providing cushioned support for the wearer.

Typically, the outsole and the midsole are fixed together with the midsole disposed between the upper and the outsole. As such, the compression, resilience, and other characteristics of the sole assembly are substantially the same, regardless of how the wearer is standing, how the leg and foot are positioned relative to each other, etc. Thus, some conventional sole assemblies may not be useful for some activities and/or for training the wearer to arrange the foot and leg in a desired posture.

For instance, a sprinter may train themselves to run in a certain posture to enhance running performance (e.g., to improve acceleration, etc.). However, because the sole assembly is substantially uniform, the sole assembly is unlikely to provide any feedback to the runner, and training can be more difficult.

SUMMARY

Accordingly, there remains a need for an article of footwear with an upper and a sole assembly. The sole assembly includes a first member that is coupled to the upper and a second member that is moveably coupled to the first member. The first member moves relative to the second member in response to a first input load directed along a first vector, and the first member engages the second member in response to a second input load directed along a second vector.

Also, an article of footwear that defines a longitudinal axis is disclosed. The article of footwear includes an upper and a sole assembly that is operably coupled to the upper. The sole assembly includes a first member with an opening, and the opening is partially defined by a wall. The sole assembly also includes a second member that is slideably disposed within the opening. The sole assembly also includes at least one biasing member that biases the second member relative to the first member. Movement of the first member relative to the second member is limited by abutment of the wall and the second member.

Moreover, an article of footwear for treading on a ground surface is disclosed. The article of footwear defines an anterior end, a posterior end, a lateral side, a medial side, and a longitudinal axis that extends between the anterior and posterior ends. The article of footwear includes an upper and a first sole member that is fixed to the upper. The first sole member is monolithic and extends from the anterior end to the posterior end and from the lateral side to the medial side. The first sole member defines a recess disposed in a metatarsal portion thereof, and the recess extends from the lateral side to the medial side. The first sole member includes a plurality of anterior coupling openings that are anteriorly disposed relative to the recess, and the first sole member also includes a plurality of posterior coupling openings that are posteriorly disposed relative to the recess. The first sole member includes a rail that extends longitudinally across the recess substantially parallel to the longitudinal axis of the article of footwear. The recess is partially defined by an anterior wall that extends between the medial and lateral sides. The article of footwear also includes a second sole member including a main body, a plurality of anterior biasing members, and a plurality of posterior biasing members. The main body is moveably received within the recess and is overlapped by the first sole member. The main body includes a groove that slidingly receives the rail. The plurality of anterior biasing members are fixedly received within corresponding ones of the plurality of anterior coupling openings to bias the first sole member posteriorly relative to the second sole member, and the plurality of posterior biasing members are fixedly received within corresponding ones of the plurality of posterior coupling openings to bias the first sole member anteriorly relative to the second sole member. The first sole member moves relative to the second sole member in response to a first input load directed along a first vector, and the anterior wall abuts the second sole member to engage the second sole member in response to a second input load directed along a second vector. The first and second vectors are directed generally toward the posterior end, the first vector being disposed at a first acute angle relative to the ground surface, and the second vector being disposed at a second acute angle relative to the ground surface. Also, the first acute angle is greater than the second acute angle.

This section provides a general summary of the disclosure, and is not a comprehensive disclosure of its full scope or all of its features. Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

FIG. 1 is a perspective view of an article of footwear according to various exemplary embodiments of the present disclosure;

FIG. 2 is a sectional view of the article of footwear taken along the line 2-2 of FIG. 1;

FIG. 3 is an exploded view of the sole assembly of the article of footwear of FIG. 1;

Corresponding reference numerals indicate corresponding parts throughout the several views of the drawings.

DETAILED DESCRIPTION

Figure 4:
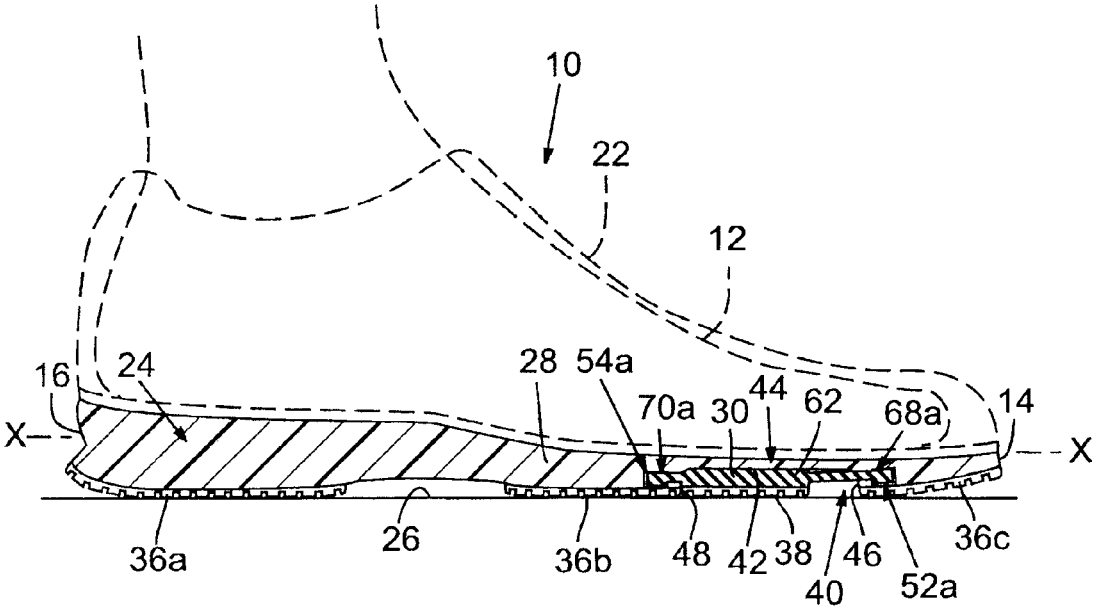
FIG. 4 is a longitudinal section view of the article of footwear of FIG. 1 wherein the wearer is standing upright.

Example embodiments will now be described more fully with reference to the accompanying drawings.

Referring initially to FIGS. 1 and 4-6, an article of footwear 10 is illustrated according to various exemplary embodiments of the present disclosure. The article of footwear 10 can fit about and support a foot 12 of a wearer (shown in phantom in FIGS. 4-6). The article of footwear 10 can define an anterior end 14, a posterior end 16, a lateral side 18, and a medial side 20. Also, the footwear 10 can define a longitudinal axis X extending between the anterior and posterior ends 14, 16. As shown, the footwear 10 can be a shoe (e.g., an athletic shoe); however, it will be appreciated that the footwear 10 could be of any suitable type other than a shoe, such as a sandal, boot, and the like without departing from the scope of the present disclosure.

Figure 5:
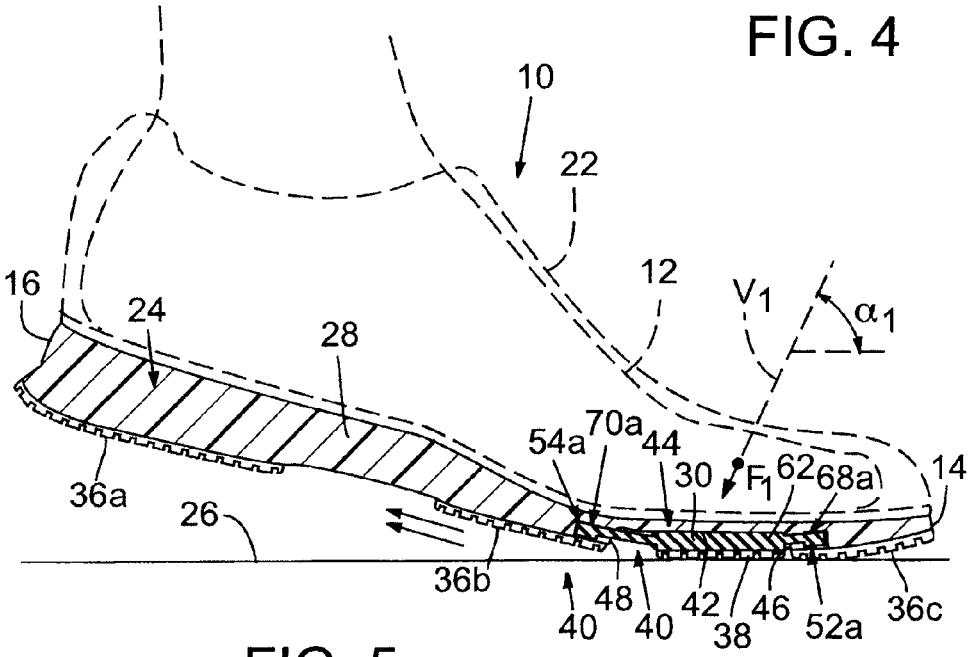
FIG. 5 is a longitudinal section view of the article of footwear of FIG. 1 wherein the wearer is pushing off a ground surface at a first angle.
Figure 6:
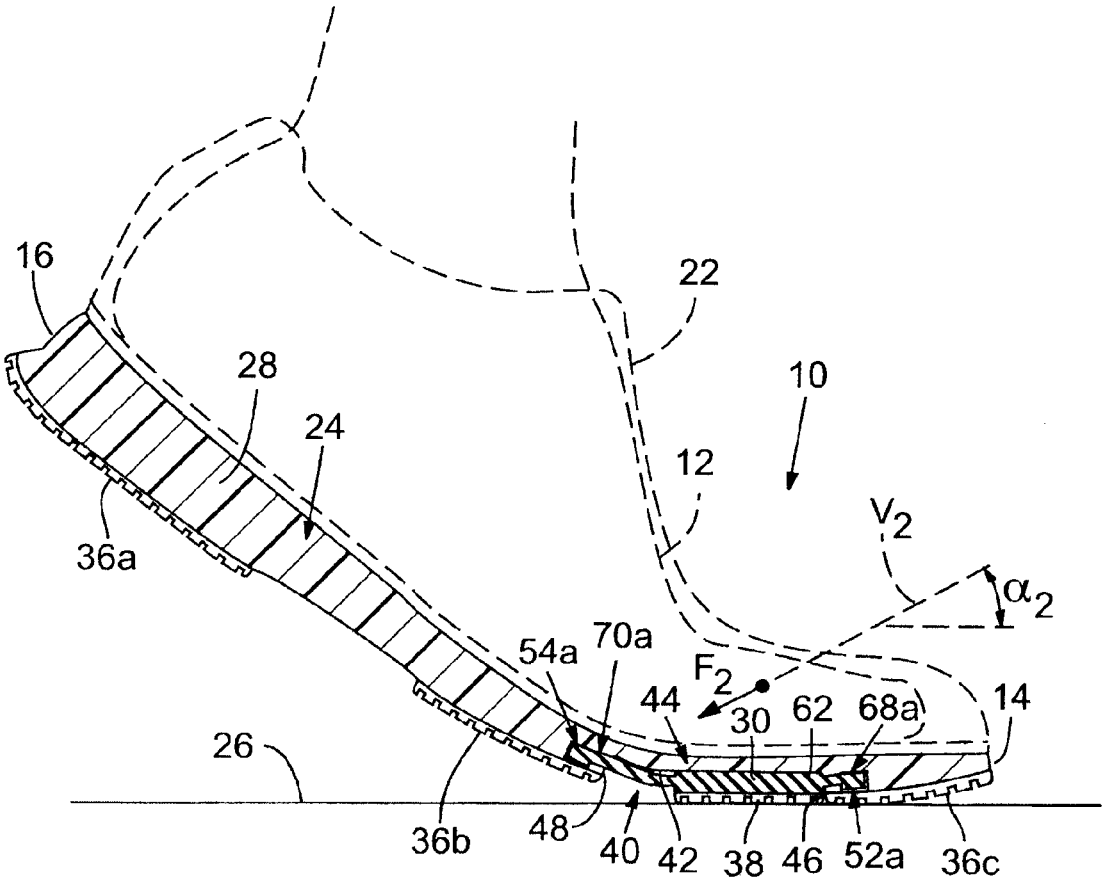
FIG. 6 is a longitudinal section view of the article of footwear of FIG. 1 wherein the wearer is pushing off a ground surface at a second angle.

As shown in FIG. 3, the article of footwear 10 can include an upper 22. The upper 22 can include one or more panels that are interconnected to define a cavity that receives the foot 12 of the wearer (FIGS. 4-6). Also, the upper 22 can include laces, buckles, pile tape, or other suitable types of means of securing the upper 22 to the foot 12.

In addition, the article footwear 10 can include a sole assembly 24 that is operably coupled to the upper 22. The sole assembly 24 can generally provide support (e.g., cushioned support) for the foot 12 and can provide traction when treading on a ground surface 26.

In general, the sole assembly 24 can include a first sole member 28 that is fixedly coupled 10 the upper 22, and the sole assembly 24 can also include a second sole member 30 that is moveably coupled to the first sole member 28. The first and second sole members 28, 30 can be made out of any suitable material and can exhibit any suitable compression characteristics. For instance, the first and/or second sole members 28, 30 can include a foam material so as to be resiliently flexible and to comprise at least a portion of a midsole for the footwear 10. Also, the first and/or second sole members 28, 30 can include a high-friction material and/or hard polymeric material to comprise at least a portion of an outsole for the footwear 10.

Moreover, as shown in FIGS. 4-6, the footwear 10 can include one or more first traction members 36*a*, 36*b*, 36*c* that are each fixed to different areas of the first sole member 28. As shown, the traction member 36*a* can be disposed adjacent the posterior end 16, the traction member 36*c* can be disposed adjacent the anterior end 14, and the traction member 36*b* can be disposed between the traction members 36*a*, 36*c*. Additionally, the footwear 10 can include one or more second traction members 38 that are fixed to the second sole member 30. The first and second traction members 36*a*, 36*b*, 36*c*, 38 can be made out of a high-friction material, such as rubber or other polymer, and can include grooves, lugs, cleats, or other similar elements for enhancing traction of the footwear 10. Accordingly, as shown in FIGS. 4-6, the first and second sole members 28, 30 can each separately engage the ground surface 26 (e.g., via the traction members 36*a*, 36*b*, 36*c*, 38).

As will be discussed, the characteristics and performance of the sole assembly 24 can vary, depending on the posture of the foot 12 (i.e., position of the foot 12 relative to the leg, the ground surface 26, etc.). For instance, as will be discussed, the first sole member 28 can move relative to the second sole member 30 when the foot 12 pushes off the sole assembly 24 (i.e., supplies an input force) in one posture, and the first sole member 28 can engage the second sole member 30 when the foot 12 pushes off in a different posture. Accordingly, pushing off the ground surface 26 and generating thrust for the wearer can be more difficult in some postures and easier in other postures. Thus, the footwear 10 can be useful for training the wearer to position the foot 12 in a particular posture.

Referring now to FIG. 3, the first sole member 28 will be discussed in greater detail. As shown, the first sole member 28 can be a relatively thin, flat, and monolithic member that extends between the anterior and posterior ends 14, 16 and that extends between the lateral and medial sides 18, 20.

Furthermore, the first sole member 28 can define an opening 40. The opening 40 can be of any type, shape, and size, and the opening 40 can be disposed in any suitable location on the first sole member 28. For instance, as shown in FIG. 3, the opening 40 can be a recess 42. In other embodiments that are not shown, the opening 40 can be a groove, a through-hole, etc.

The recess 42 can be disposed in a metatarsal portion 44 of the sole assembly 24. As such, the recess 42 can be disposed substantially underneath the metatarsals or ball of the foot 12. However, it will be appreciated that the recess 42 could be disposed anywhere on the first sole member 28 of the sole assembly 24.

The recess 42 can extend longitudinally and continuously from the lateral side 18 to the medial side 20 of the footwear 10. Also, the recess 42 can be defined by an anterior wall 46, a posterior wall 48, and an internal surface 50. Both the posterior and anterior walls 46, 48 can extend transverse (e.g., substantially perpendicular) to the longitudinal axis X. The internal surface 50 can extend between the posterior and anterior walls 46, 48.

Moreover, the first sole member 28 can define at least one coupling opening 52*a*, 52*b*, 54*a*, 54*b*. For instance, as shown in FIG. 3, the first sole member 28 can include a plurality (e.g., a pair) of anterior coupling openings 52*a*, 52*b* and a plurality (e.g., a pair) of posterior coupling openings 54*a*, 54*b*. The pair of anterior coupling openings 52*a*, 52*b* can be disposed on opposite sides of the axis X, and the pair of posterior coupling openings 54*a*, 54*b* can also be disposed on opposite sides of the axis X. The anterior coupling openings 52*a*, 52*b* can be in communication with and can extend in an anterior direction from the recess 42, and the posterior coupling openings 54*a*, 54*b* can be in communication with and can extend in a posterior direction from the recess 42. In some embodiments, each of the coupling openings 52*a*, 52*b*, 54*a*, 54*b* can extend at an acute angle away from the axis X. Furthermore, the anterior and posterior coupling openings 52*a*, 52*b*, 54*a*, 54*b* can each include a respective enlarged portion 56 and a slot 58. The enlarged portion 56 can be of any suitable shape, such as cylindrical, and the slot 58 can be elongate and thinner than the enlarged portion 56. The slot 58 can be disposed between the recess 42 and the respective enlarged portion 56.

In addition, as shown in FIG. 3, the first sole member 28 can include a rail 60. The rail 60 can be substantially straight and can be substantially parallel to the longitudinal axis X. The rail 60 can be fixedly (e.g., integrally) attached to the internal surface 50 and can extend longitudinally between the posterior and anterior walls 46, 48 of the first sole member 28. Moreover, as shown in FIG. 2, the rail 60 can be tapered in cross section.

Referring now to FIG. 3, the second sole member 30 will be discussed in greater detail. As shown, the second sole member 30 can include a main body 62 that is generally flat and relatively thin. The main body 62 can extend continuously from the lateral side 18 to the medial side 20.

The main body 62 of the second sole member 30 can be disposed in the recess 42 so as to be overlapped by the first sole member 28. More specifically, the main body 62 can be moveably disposed in the recess 42 such that the first sole member 28 and the second sole member 30 can move relative to each other. In some embodiments, the main body 62 can be slideably coupled to the first sole member 28. For instance, the main body 62 can define a groove 64 (FIGS. 2 and 3) that slideably receives the rail 60 of the first sole member 28. The groove 64 can correspond in shape and size to the rail 60. As such, the main body 62 can slide along and be guided by the rail 60 in a direction substantially parallel to the longitudinal axis as will be discussed in greater detail.

Also, in some embodiments, a low-friction material (not particularly shown) can be disposed on the rail 60 and/or within the groove 64 to facilitate sliding of the first sole member 28 relative to the second sole member 30. For instance, the low-friction material can be laminated on the rail 60 and/or the groove 64. It will be appreciated that the main body 62 can be configured such that the main body 62 slides only on the rail 60, or the main body 62 can be configured such that the main body 62 slides on and contacts a larger area of the internal surface 50 of the first sole member 28.

Additionally, as shown in FIG. 3, the second sole member 30 can include one or more biasing members 68*a*, 68*b*, 70*a*, 70*b* that bias the second sole member 30 relative to the first sole member 28. More specifically, the second sole member 30 can include one or more (e.g., a pair) of anterior biasing members 68*a*, 68*b* and one or more (e.g., a pair) of posterior biasing members 70*a*, 70*b*. The biasing members 68*a*, 68*b*, 70*a*, 70*b* can be resiliently flexible. Each of the biasing members 68*a*, 68*b*, 70*a*, 70*b* can be fixedly coupled to the main body 62. For instance, the biasing members 68*a*, 68*b*, 70*a*, 70*b* can be integrally coupled to the main body 62 to be monolithic therewith. The pair of anterior biasing members 68*a*, 68*b* can each be disposed on opposite sides of the axis X and can each extend anteriorly from the main body 62 and at an acute angle relative to the axis X. The pair of posterior biasing members 70*a*, 70*b* can each be disposed on opposite sides of the axis X and can each extend posteriorly from the main body 62 and at an acute angle relative to the axis X.

Each of the biasing members 68*a*, 68*b*, 70*a*, 70*b* can include a respective head 72 and a respective band 74 that connects the head 72 to the main body 62. The shape of the head 72 can correspond to that of the enlarged portions 56 of the first sole member 28, and the shape of the band 74 can correspond to that of the slots 58 of the first sole member 28. Thus, each head 72 can be received within a respective enlarged portion 56, and each band 74 can be received within a respective slot 58 to thereby couple the biasing members 68*a*, 68*b*, 70*a*, 70*b* to the first sole member 28.

Thus, when the first sole member 28 moves anteriorly relative to the second sole member 30, the anterior biasing members 68*a*, 68*b* can bias the first sole member 28 posteriorly. On the other hand, when the first sole member 28 moves posteriorly relative to the second sole member 30, the posterior biasing members 70*a*, 70*b* can bias the first sole member 28 anteriorly. Thus, a neutral position of the first sole member 28 relative to the second sole member 30 can be maintained. As shown in FIG. 4, for instance, the neutral position of the second sole member 30 can be such that the second sole member 30 abuts the posterior wall 48 of the recess 42 and the second sole member 30 is spaced apart at a distance from the anterior wall 46. As will be described, when the first sole member 28 moves relative to the second sole member 30, the second sole member 30 can be biased toward the neutral position shown in FIG. 4. Also, in this neutral position, one or more of the biasing members 68*a*, 68*b*, 70*a*, 70*b* can be in tension. Moreover, in this neutral position, one or more of the biasing members 68*a*, 68*b*, 70*a*, 70*b* can be untensioned. It will be appreciated that the second sole member 30 can have any suitable neutral position relative to the first sole member 28 without departing from the scope of the present disclosure.

It will be appreciated that, in other embodiments, the biasing members 68*a*, 68*b*, 70*a*, 70*b* can be attached to the first sole member 28, and the coupling openings 52*a*, 52*b*, 54*a*, 54*b* can be defined in the second sole member 30 without departing from the scope of the present disclosure. Moreover, in some embodiments, the biasing members 68*a*, 68*b*, 70*a*, 70*b* can be removably coupled to both the first and second sole members 28, 30. Still further, the rail 60 can be attached to the second sole member 30 while the groove 64 can be defined in the first sole member 28.

Referring now to FIGS. 4-6, the operation of the article of footwear 10 will be discussed in greater detail. As discussed above, FIG. 4 illustrates the footwear 10 with the second sole member 30 in a neutral position according to an exemplary embodiment. FIGS. 5 and 6 illustrate the second sole member 30 moved away from this neutral position.

Specifically, FIGS. 5 and 6 illustrate the foot 12 attempting to push off the ground surface 26 via the sole assembly 24 at two different postures of the foot 12. More specifically, FIG. 5 illustrates the foot 12 applying an input load $F_1$ along a first vector $V_1$, which is directed generally toward the posterior end 16 and the ground surface 26 at a first acute angle $\alpha_1$ relative to the ground surface 26, FIG. 6 illustrates the foot 12 applying an input load $F_2$ along a second vector $V_2$, which is directed generally toward the posterior end 16 and the ground surface 26 at a first acute angle $\alpha_2$ relative to the ground surface 26. The first angle $\alpha_1$ can be greater than the second angle $\alpha_2$. Thus, in the posture shown in FIG. 6 the foot 12 is generally higher off the ground surface 26 than the posture shown in FIG. 6, and the rest of the body of the wearer (not shown) would likely be lower to the ground surface 26. In some embodiments, both FIGS. 5 and 6 can illustrate an attempt to take-off or thrust forward from a stand-still position, for instance, a posture of a sprinter at a start of a run.

In the posture shown in FIG. 5, the input load $F_1$ is likely to plant the second sole member 30 against the ground surface 26, and the first sole member 28 is likely to slide and slip posteriorly relative to the second sole member 30 without significantly engaging the second sole member 30.

Accordingly, the reaction force from the ground surface 26 to the foot 12 is less likely to thrust the foot 12 and footwear 10 forward.

On the other hand, in the posture shown in FIG. 6, the input load $F_2$ is likely to plant the second sole member 30 against the ground surface 26, and the anterior wall 46 of the first sole member 28 can abut the second sole member 30, thereby engaging the first and second sole members 28, 30, thereby limiting movement of the first sole member 28 relative to the second sole member 30 in the posterior direction, and thereby generating greater forward thrust for the foot 12 and footwear 10.

In some embodiments, the footwear 10 can be utilized when training an athlete. For instance, the wearer's running performance can be studied, and a particular posture (e.g., the posture of FIG. 6) can be deemed optimal for generating increased thrust. The footwear 10 can be designed such that the first and second sole members 28, 30 abut when the foot 12 is positioned at this predetermined posture. In the embodiment of FIG. 6, the footwear 10 can be used to train the athlete to raise the foot 12 higher off the ground surface 26 and to move the rest of the body (not shown) closer to the ground surface 26.

It will be appreciated that the footwear 10 could be designed for other types of training. For instance, the first and second sole members 28, 30 could be designed for relative movement in the medial and lateral directions, and such footwear 10 could be used to train the wearer for side-to-side movement.

In any case, the footwear 10 can be a useful training tool for enhancing the performance and abilities of the wearer. Also, the footwear 10 can be used for neuromuscular training to thereby get enhanced neural response from the wearer. Also, the footwear 10 can be used outside of a training event, such as during a competition, and the footwear 10 can enhance acceleration of the wearer.

Figure 7:
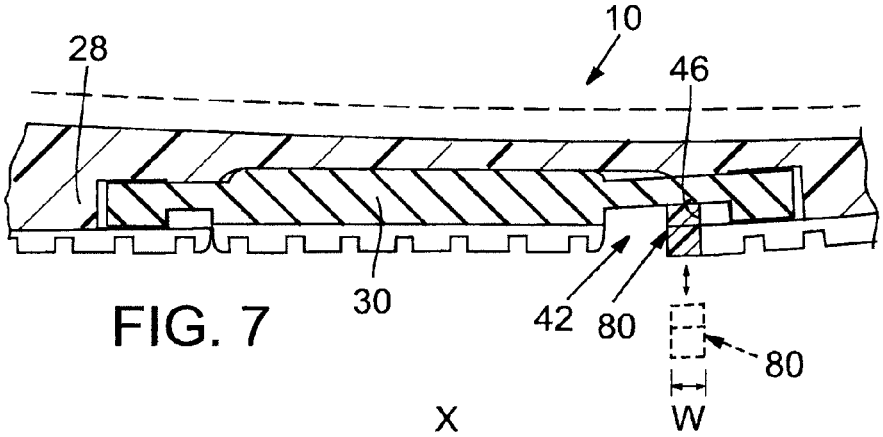
FIG. 7 is a longitudinal section view of an article of footwear according to various additional exemplary embodiments of the present disclosure.

Moreover, the footwear 10 can be customizable in various ways. For instance, in the embodiment shown in FIG. 7, the first sole member 28 can include a removable insert 80 used for customizing or otherwise altering the relative movement of the first and second sole members 28, 30.

The insert 80 can be substantially rigid member of any particular shape and size (e.g., an elongate member). The insert 80 can be a removable part of the first sole member 28. For instance, the insert 80 can be removably attached to the first sole member 28, within the recess 42. The insert 80 can be removably coupled in any suitable fashion (e.g., fasteners, interference fit, adhesives, etc.). The insert 80 can be removably fixed to the first sole member 28 adjacent the anterior wall 46 of the recess 42. As such, the insert 80 can cover substantially the entire anterior wall 46 to be disposed between the anterior wall 46 and the second sole member 30. Accordingly, the insert 80 can selectively vary the available space within the recess 42. For instance, without insert 80 attached, the recess 42 can be larger, and with the insert 80 attached, the recess 42 can be smaller.

Thus, when the insert 80 is removed, the footwear 10 can perform as discussed above with respect to FIGS. 5 and 6. However, with the insert 80 attached, when the wearer applies the input load $F_2$ (FIG. 6), the second sole member 30 can slide over a shorter distance before abutting and engaging the insert 80. Accordingly, the insert 80 can be used for customizing engagement and disengagement of the first and second sole members 28, 30.

It will be appreciated that the size (e.g., width W) of the insert 80 can vary according to the desires of the wearer in order to provide the desired performance of the footwear 10.

It will also be appreciated that the footwear 10 can be customized in other suitable ways. For instance, in some embodiments, the spring force of one or more of the biasing members 68*a*, 68*b*, 70*a*, 70*b* can be varied or the biasing member(s) can be replaced with different biasing members 68*a*, 68*b*, 70*a*, 70*b* to change the respective spring force. Accordingly, the force necessary to engage the first and second sole members 28, 30 can be varied.

Additionally, these customizations and modifications can be accomplished in a variety of ways. For instance, as described above, the footwear 10 can be disassembled and re-assembled using the desired insert(s) 80, replaceable biasing members 68*a*, 68*b*, 70*a*, 70*b*, interchangeable second sole members 30, or using other interchangeable components. In other embodiments, the footwear 10 can include various controls, such as a hand-operated dial, switch, slider, or other control mechanism. By manipulating or otherwise controlling this mechanism, the user can vary the spring force of the biasing members 68*a*, 68*b*, 70*a*, 70*b*, can vary the size of the recess 42, or otherwise change the ability of the first and second sole members 28, 30 to engage and disengage.

It will be appreciated that the footwear 10 can include any suitable number of sole members 28, 30, which are moveable relative to each other. Also, the sole members 28, 30 can be located in any suitable location and can engage and disengage due to movement in any suitable direction relative to the axis X.

Figure 8:
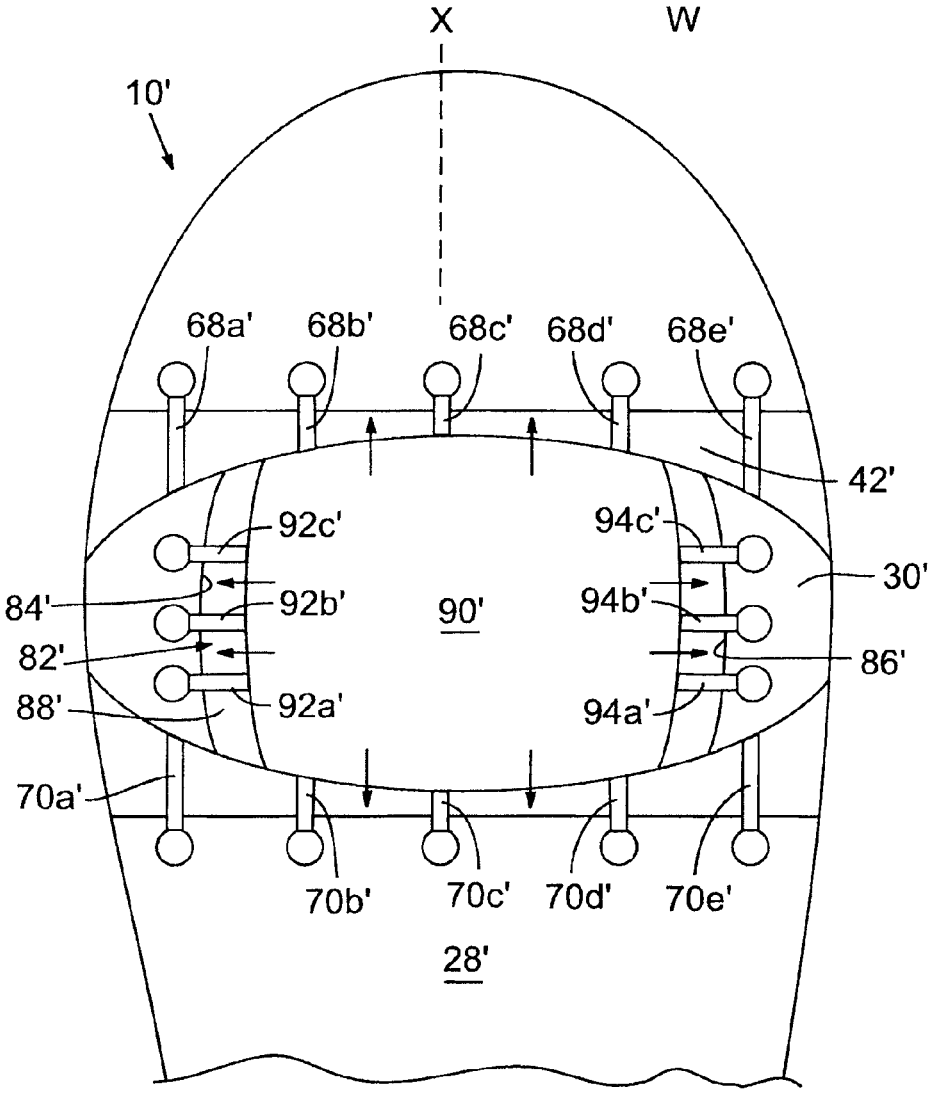
FIG. 8 is a bottom view of the article of footwear according to various additional exemplary embodiments of the present disclosure.

In this respect, FIG. 8 illustrates another exemplary embodiment of the footwear 10'. As shown, the footwear 10' includes the first sole member 28' and the second sole member 30', which is moveably disposed within the recess 42' of the first sole member 28'. The footwear 10' also includes a plurality of biasing members 68*a*'-68*e*', 70*a*'-70*e*' similar to the embodiments discussed above. Moreover, the second sole member 30' can also include a recess 82' therein. The recess 82' can be defined by a medial wall 84', a lateral wall 86', and an internal surface 88'.

The footwear 10' can also include a third sole member 90' substantially similar to the second sole member 30'. However, the third sole member 90' can be moveably disposed within the recess 82' of the second sole member 30'. For instance, the third sole member 90' can be slidably disposed within the recess 82' so as to slide laterally and medially (i.e., transverse to the X-axis). Transverse movement of the third sole member 90' relative to the second sole member 30' can be limited by abutment (i.e., engagement) between the third sole member 90' and the medial wall 84' and/or abutment (i.e., engagement) between the third sole member 90' and the lateral wall 86'.

Moreover, the footwear 10' can include one or more first transverse biasing members 92*a*'-92*c*' and second transverse biasing members 94*a*'-94*c*' that are substantially similar to the biasing members 68*a*'-68*e*', 70*a*'-70*e*'. The first transverse biasing members 92*a*'-92*c*' can bias the third sole member 90' toward the medial wall 84', and the second transverse biasing members 94*a*'-94*c*' can bias the third sole member 90' toward the lateral wall 86'.

Accordingly, the second sole member 30' can selectively engage with and disengage from the first sole member 28' depending on the vector of the input force substantially along the axis X. Also, the third sole member 90' can engage with and disengage from the second sole member 30' depending on the vector of the input force substantially transverse to the axis X. As such, the footwear 10' can be a useful training tool for enhancing the axial as well as lateral movement of the wearer. Also, the footwear 10 can be used for neuromuscular training for enhancing axial and lateral movement of the wearer.

The foregoing description of the embodiments has been provided for purposes of illustration and description. It is not intended to be exhaustive or to limit the invention. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the invention, and all such modifications are intended to be included within the scope of the invention.

What is claimed is:

1. An article of footwear comprising:

an upper; and a sole assembly that is coupled to the upper and that defines a ground engaging surface, the sole assembly including a first member and a second member, the first member defining a recess, the second member being disposed within the recess, the second member being moveably coupled to the first member for movement within the recess between a first position and a second position relative to the first member, the second member configured to move linearly within the recess along a substantially straight line relative to the first member when moving between the first position and the second position, the first member defining a first portion of the ground engaging surface of the sole assembly, the second member defining a second portion of the ground engaging surface of the sole assembly, the first and second portions of the ground engaging surface being substantially level with each other when in the first position and the second position.

2. The article of footwear of claim 1, wherein the second member is slidably coupled to the first member for sliding movement along the substantially straight line.

3. The article of footwear of claim 2, wherein one of the first and second members includes a rail with a substantially straight longitudinal rail axis, and the other of the first and second members includes a groove that slideably receives the rail to slidably couple the first and second members for linear movement along the longitudinal rail axis.

4. The article of footwear of claim 3, wherein the rail extends substantially parallel to a longitudinal footwear axis of the article of footwear to guide movement of the first and second members relative to each other substantially parallel to the longitudinal footwear axis.

5. The article of footwear of claim 3, wherein the rail and the groove are both tapered in a cross section taken substantially perpendicular to the longitudinal rail axis.

6. The article of footwear of claim 1, wherein the first portion of the ground engaging surface of the first member and the second portion of the ground engaging surface of the second member both lie substantially within a common plane when in the first position and the second position.

7. The article of footwear of claim 1, wherein the recess is defined by an internal surface and a wall, the wall extending between the internal surface and the first portion of the ground engaging surface, and wherein movement of the second member relative to the first member is limited by abutment between the second member and the wall.

8. The article of footwear of claim 1, wherein the recess is disposed on a metatarsal portion of the sole assembly.

9. The article of footwear of claim 1, further comprising a removable insert that is disposed within the recess, the removable insert being removably secured within the recess, and wherein the second member is configured to move relative to the removable insert and the first member when moving between the first position and the second position.

10. The article of footwear of claim 1, further comprising at least one resilient biasing member that couples the first member and the second member, and wherein the at least one resilient biasing member biases the second member toward one of the first position and the second position.

11. The article of footwear of claim 1, further comprising a first biasing member that resiliently deflects to bias the second member in a first direction relative to the first member, and further comprising a second biasing member that resiliently deflects to bias the second member in a second direction relative to the first member, the first direction being opposite the second direction.

12. The article of footwear of claim 1, wherein one of the first member and the second member includes a biasing member, wherein the biasing member is resilient, wherein the biasing member is integrally attached to the one of the first member and the second member, wherein the other of the first member and the second member includes a coupling opening that receives the biasing member to couple the first member and the second member together, and wherein the biasing member resiliently deflects to bias the second member relative to the first member.

13. The article of footwear of claim 1, wherein the sole structure includes a medial side and a lateral side, wherein the recess extends between the medial side and the lateral side, wherein the recess is open to both the medial side and the lateral side, and wherein the second member is exposed at both the medial side and the lateral side.

14. An article of footwear comprising:

an upper;

a sole assembly that is coupled to the upper, the sole assembly including:

a first member having a first ground engaging surface and a recess, the recess being defined by an internal surface, a first wall, and a second wall, the first wall and the second wall both extending between the internal surface and the first ground engaging surface; and a second member with a second ground engaging surface, the second member being disposed within the recess, the second member being coupled to the first member for substantially linear movement within the recess between a first position and a second position, the second member being spaced away from the first wall and the second wall in the first position, the second member abutting one of the first wall and the second wall in the second position;

the second ground engaging surface being substantially level with the first ground engaging surface when in both the first position and the second position.

15. The article of footwear of claim 14, wherein one of the first and second members includes a rail with a substantially straight longitudinal rail axis, and wherein the other of the first and second members includes a groove that receives the rail, the second member configured to slide along the longitudinal rail axis when moving between the first position and the second position.

16. The article of footwear of claim 14, wherein one of the first member and the second member includes a biasing member, wherein the biasing member is resilient, wherein the other of the first member and the second member includes a coupling opening that receives the biasing member to couple the first member and the second member together, and wherein the biasing member is configured to bias the second member toward at least one of the first position and the second position.

17. The article of footwear of claim 14, wherein the sole assembly includes an anterior end, a posterior end, a medial side, and a lateral side, wherein the first wall extends between the medial side and the lateral side, and wherein the second wall extends between the medial side and the lateral side, and wherein the second member is configured to move relative to the first member generally between the anterior end and the posterior end when moving between the first position and the second position.

18. The article of footwear of claim 17, wherein the recess is open to both the medial side and the lateral side, and wherein the second member is exposed at both the medial side and the lateral side.

19. An article of footwear comprising: an upper; and a sole assembly that is coupled to the upper, the sole assembly including: a first member having a first ground engaging surface and a recess, the recess defined by an internal surface and a wall, the wall extending between the internal surface and the first ground engaging surface; and a second member with a second ground engaging surface, the second member being disposed within the recess, the second member being configured for movement within the recess toward the wall and away from the wall relative to the first member, the second ground engaging surface configured to remain substantially level with the first ground engaging surface as the second member moves toward the wall and away from the wall, wherein one of the first and second members includes a rail, wherein the other of the first and second members includes a groove that receives the rail to guide movement of the second member toward the wall and away from the wall relative to the first member.

20. The article of footwear of claim 19, wherein the wall is a first wall, wherein the recess is further defined by a second wall, wherein the second wall extends between the first ground engaging surface and the internal surface, and wherein the rail extends in a substantially straight direction along the internal surface between the first wall and the second wall.

* * * * *